United States Patent [19]

Osako

[11] 4,428,501

[45] Jan. 31, 1984

[54] PAPER SHEET DISPENSER

[75] Inventor: Kyoichi Osako, Tokyo, Japan

[73] Assignee: Laurel Bank Machine Co., Ltd., Tokyo, Japan

[21] Appl. No.: 267,804

[22] Filed: May 28, 1981

[30] Foreign Application Priority Data

May 30, 1980 [JP] Japan ..... 55-72545

[51] Int. Cl.[3] ..... B65H 39/041

[52] U.S. Cl. ..... 221/13; 271/9

[58] Field of Search ..... 221/9, 13, 21; 271/9; 209/534; 194/4 C, 4 E

[56] References Cited

U.S. PATENT DOCUMENTS 3,675,816 7/1972 Bourke et al. ..... 221/13 X 3,760,158 9/1973 Whitehead et al. ..... 221/9

3,805,937 4/1974 Hatanaka et al. ..... 221/9 X

*Primary Examiner*—Stanley H. Tollberg

*Attorney, Agent, or Firm*—Fleit, Jacobson, Cohn & Price

[57] ABSTRACT

There is provided a paper sheet dispenser of the type from which several different kinds of sheet material are dispensed. The paper sheet dispenser of the invention is provided with a discriminator for comparing the total number of paper sheets to be dispensed with the upper limit number which can be dispensed at one time to develop a branch instruction that the operations be carried out according to a branch program when the former-mentioned number is not less than the upper limit number. According to the branch program, paper sheets are divided into two or more groups in such a manner that paper sheets of any one kind are never divided into two fragmental segments to avoid confusion. On the other hand, when the total number of paper sheets to be dispensed is less than the upper limit number, paper sheets of every designated kind are dispensed collectively at one time. It is possible to instruct that a single kind of paper sheet be dispensed at a time.

2 Claims, 5 Drawing Figures

PAPER SHEET DISPENSER

BACKGROUND OF THE INVENTION

1. Field of the Invention

The present invention relates to a paper sheet dispenser, and particularly to a paper sheet dispenser of the type from which several different kinds of sheet material are dispensed such that instructed numbers of any one or more kinds of sheet material are dispensed as desired. Such a dispenser of this type is particularly useful when assembled in a bank note dispensing apparatus, and the present invention will be described hereinafter by referring to a bank note dispensing apparatus incorporating the principle of the invention.

2. Prior Art

In general, the number of bank notes which can be dispensed at one time is limited due to the structural limitations imposed by the design and physical dimensions of the dispensing port and mechanism. In the conventional bank note dispensing apparatus, when the number of bank notes paid out of the stack boxes and accumulated at the accumulation station to be ready for dispensing reaches the upper limit, the operation of paying a further bank note is prohibited until the bundle of bank notes conveyed to the dispensing port has been taken out of the dispensing apparatus by an operator or a user. The dispensing apparatus is released from this standstill condition when the bundle of bank notes forwarded to the dispensing port has been taken off, and the operation of paying out and accumulating the bank notes is re-started.

However, the aforementioned bank note dispensing apparatus of the prior art has a disadvantage in that the operator of the apparatus who takes off the bundle from the dispensing port, for example a bank clerk, cannot known at which condition the paying operation is interrupted unless he calculates mentally by himself. Another disadvantage is that the paying operation is often interrupted at a point midway of paying out a certain kind of bank notes, resulting in divided delivery of that certain kind of bank notes to compel the operator to hold the bank notes of the thus divided kind by hand and to wait for the next delivery of the same kind of bank notes without performing the manual inspection operation.

By way of example, assume that the upper limit of bank notes which can be dispensed at one time is 100 and the instructed numbers for the first, second, third and fourth kinds of bank notes are 50, 38, 23 and 10, respectively. The total number of bank notes to be dispensed amounts to 121. By the use of the conventional bank note dispensing apparatus, 50 sheets of the first kind bank note, 38 sheets of the second kind and 12 sheets of the third kind bank note are dispensed by the first delivery, and the remaining 11 sheets of the third kind of bank note and 10 sheets of the fourth kind of bank note are dispensed by the next delivery. The bank notes of the third kind are thus divided into two segments which are separately delivered in two steps. Such a mode of delivery is apt to give rise to confusion or to lead the operator to make mistakes.

SUMMARY AND OBJECT OF THE INVENTION

An object of the present invention is to overcome the disadvantages of the conventional paper sheet dispensing apparatus as described above.

More specifically, the object of the present invention is to provide a paper sheet dispensing apparatus by which any kind of paper sheets is never divided into two fragmentary segments.

Another object of the present invention is to provide a paper sheet dispensing apparatus which can dispense a single kind of paper sheet at a time.

According to the present invention, the aforementioned objects thereof can be attained by the provision of a paper sheet dispensing apparatus having a memory unit for storing the upper limit number of paper sheets which can be dispensed at one time, a comparator for comparing the upper limit number with the total number of paper sheets instructed to be dispensed, means responsive to the signal fed from the comparator for delivering paper sheets of different kinds collectively at one time when the total number of paper sheets to be dispensed is less than the stored upper limit number, and means responsive to the signal fed from the comparator for delivering paper sheets in two or more steps while preventing any kind of paper sheets from being divided into two fragmentary segments to obviate separate deliveries of an individual kind of paper sheet.

DESCRIPTION OF THE DRAWINGS

A more complete understanding of the apparatus according to the present invention can be had by reference to the accompanying drawings in which:

FIGS. 3A and 3B are flow charts showing the operations of the bank note dispensing arrangement shown in FIG. 1 and the operations of the data processor shown in FIG. 2.

DESCRIPTION OF THE PREFERRED EMBODIMENTS

Figure 1:
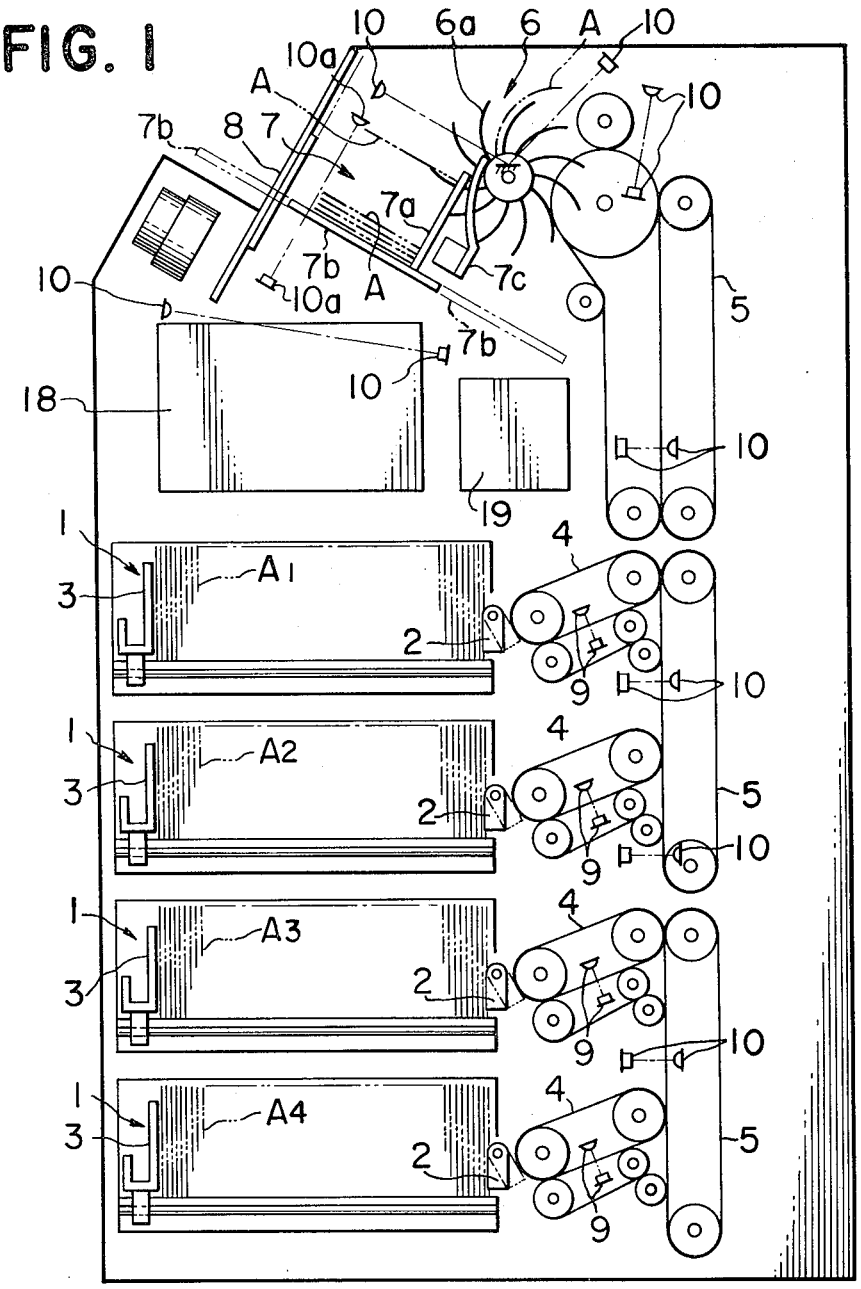
FIG. 1 is a schematic representation of an embodiment of the invention showing, in somewhat diagrammatical fashion, the important parts of a bank note dispensing arrangement.

Referring in detail to the drawings, particularly to FIG. 1 showing the mechanical elements of a bank note dispensing apparatus according to the present invention, stack boxes for containing bank notes are generally denoted by 1. In the illustrated embodiment, four stack boxes each for containing 10,000-yen notes $A_1$, 5,000-yen notes $A_2$, 1,000-yen notes $A_3$ and 500-yen notes $A_4$ are provided, as shown in FIG. 1. Each of the stack boxes 1 has a suction head 2 swingably mounted on the inner or fore end wall of the box and a movable push plate 3, and contains a multiplicity of bank notes. The bank notes are clamped between the movable push plate 3 and the fore end wall of the box while being held in the upstanding condition with their faces overlaid in the face-to-face relationship.

Upon receipt of a signal for paying out a bank note, the suction head 2 is actuated to grasp a bank note and then is swung to lead one end of the bank note onto a paying belt assembly 4. The bank note grasped by the paying belt assembly 4 is drawn out of the box 1 to be passed to a conveyor belt assembly 5 which conveys the bank note upwards until it is inserted in-between adjacent paddles 6*a* of a rotating paddle wheel 6. The bank note A inserted in-between the adjacent paddles 6*a* is carried to a position above an accumulation station 7, where the bank note is scraped away from the rotating paddle wheel 6 by a scraper plate 7a. A carrier plate 7b is provided at the accumulation station 7, and the instructed number of bank notes of one or more kinds will be accumulated on the carrier plate 7b. Upon completion of the accumulation operation, the carrier plate 7b is pushed out of a dispensing port 8 by the action of a thrusting member 7c.

A sensor assembly 9 is arranged in the way of the paying belt assembly 4 to sense a passing bank note. This sensor assembly is electrically connected to a control section 14, which will be described in detail hereinafter, so that the signals generated from the sensor assembly 9 for every passing bank notes are fed to the control section to count the number of bank notes paid from each stack box. A plurality of detection sensor assemblies 10 is arranged in the route along which the bank notes are conveyed. These detection sensor assemblies are provided to generate signals for controlling the timing of respective control operations. A reject box 18 is provided to receive the accumulated bank notes from the carrier plate 7b when any malfunction occurs in the paying operation, for example when two sheets of bank notes are paid out concurrently at one time or any one of the bank notes is folded or positioned obliquely. A driving motor for driving the aforementioned moving parts is diagrammatically shown by 19.

Figure 2:
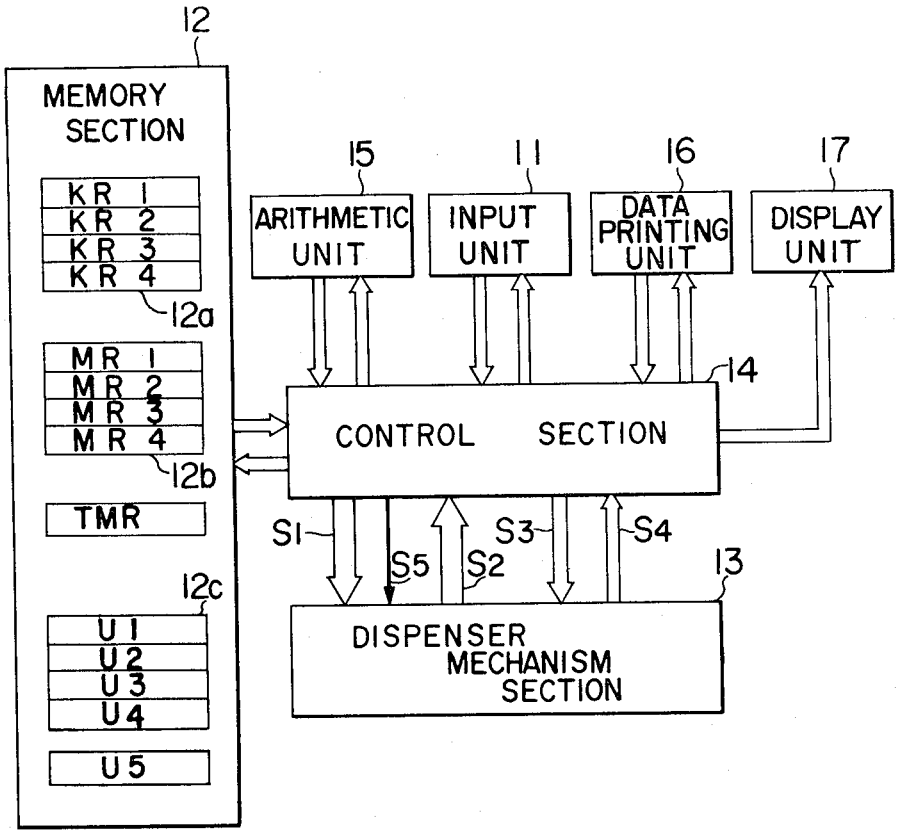
FIG. 2 is a block diagram showing the outline of the data processor assembled with the arrangement shown in FIG. 1.

Now referring to FIG. 2, the data processor for controlling the operations of the aforementioned mechanical parts of the apparatus will be described.

The data processor includes an input unit 11 having figure keys, buttons for designating the kind of bank notes to be paid out, a start button and an upper limit number setting button, all of these keys and buttons being not shown in the Figure. Using this input unit 11, the operator can input the signals instructing the kinds and number of bank notes to be paid out. Also, the upper limit number is set or reset through the input unit 11, and the bank note dispensing apparatus is started by depressing the start button.

A memory section 12 for storing the data has a memory 12a for storing the subtotals of money for respective bank notes to be paid out, a memory 12b for storing the numbers of sheets for respective bank notes to be paid out, a memory TMR for storing the grand total number of sheets to be paid out, a memory 12c for storing unit amounts of money for respective bank notes, and a memory $U_5$ for storing the upper limit number which can be dispensed at one time. In the illustrated example, the memory 12a for storing the subtotals of money for respective bank notes is composed of the memories $KR_1$, $KR_2$, $KR_3$ and $KR_4$ corresponding, respectively, to the 10,000-yen note, 5,000-yen note, 1,000-yen note and 500-yen note. Similarly, the memory 12b for storing the numbers of sheets for respective bank notes is composed of memories $MR_1$, $MR_2$, $MR_3$ and $MR_4$, and the memory 12c for storing the unit values of money for respective bank notes is composed of memories $U_1$, $U_2$, $U_3$ and $U_4$. The data stored in the memory 12c and the memory $U_5$ are those which should be fixedly stored therein. Accordingly, in the illustrated example, the data $U_1=10{,}000$ yen, $U_2=5{,}000$ yen, $U_3=1{,}000$ yen, $U_4=500$ yen and $U_5=100$ sheets (in the case where the upper limit number of sheets which can be dispensed at one time is 100) have been stored.

A dispenser mechanism section 13 includes the suction heads 2, the paying belt assemblies 4, the conveyer belt assemblies 5, the paddle wheel 6, the accumulation station 7, the sensor assemblies 9 and the detection sensor assemblies 10, as have been described hereinbefore.

A control section 14 is provided for receiving signals from the input unit 11 and for processing the data, and is connected to an arithmetic unit 15 which provides the grand total number of sheets to be paid out. The control section 14 has discrimination means for comparing the result of arithmetic operation by the unit 15 with the stored memory $U_5$ relating to the upper limit number of sheets to put out a discrimination instruction. The start signal from the input unit 11, the counting signals from the sensor assemblies 9 and the detection signals from the detection sensor assemblies 10 are fed to the control section 14 which processes the data in accordance with the program shown in the flow chart described hereinafter. Using the input unit 11, the operator can give an instruction code instructing the mode of dispensation, i.e., instructing that every kind of bank note may be dispensed together, or instructing that each kind of bank note should be dispensed singly. The control section 14 is connected with a data printing unit 16 for printing out the kinds and numbers of bank notes which have been paid out, and also connected with a display unit 17 for displaying the data.

Figure 3A:
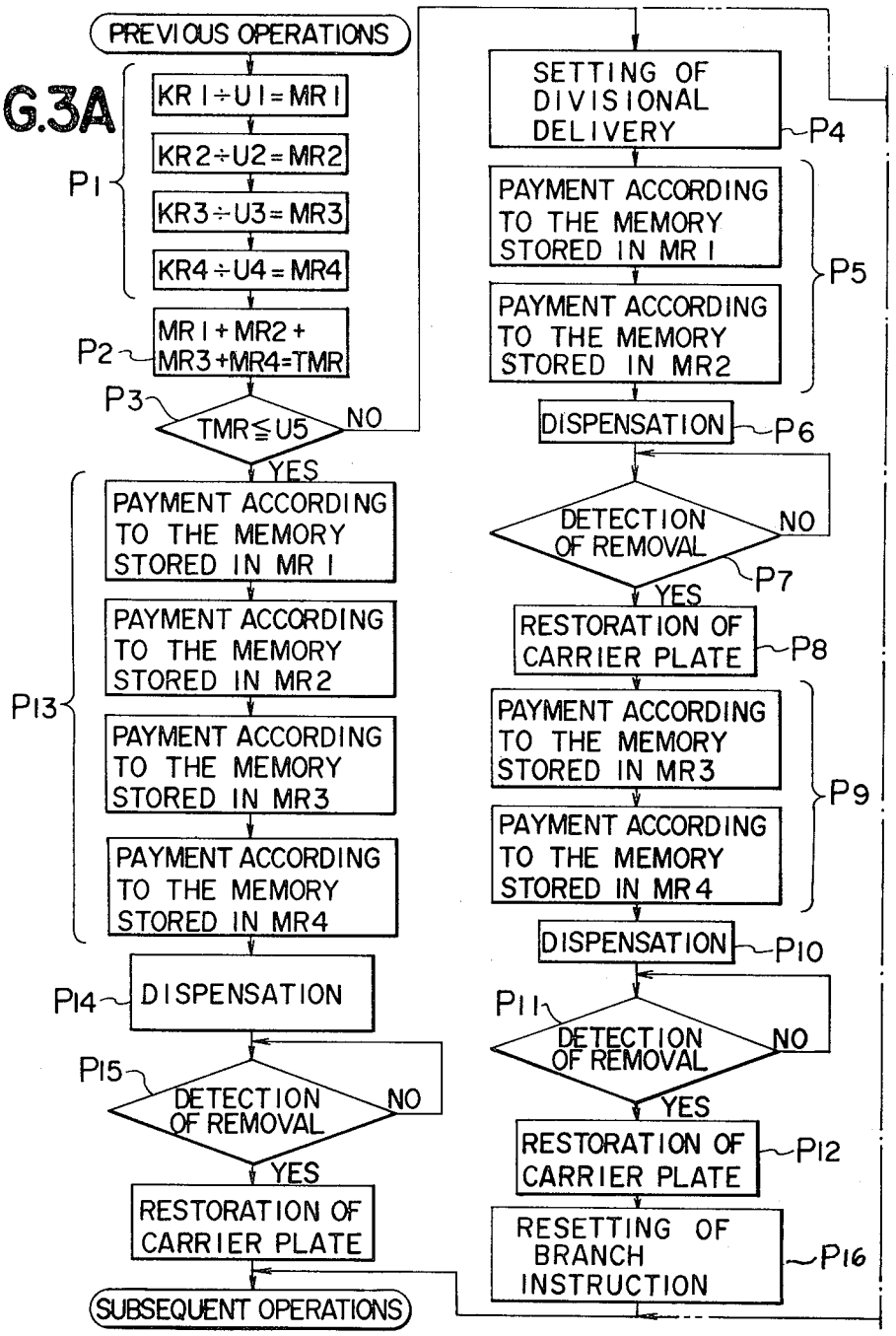
FIGS. 3A and 3B are aligned.

The operation of the bank note dispensing apparatus will now be described hereinbelow with reference to the flow charts shown in FIGS. 3A and 3B.

As an example, the following description will be given while assuming that 500,000 yen is to be paid by 10,000-yen notes, 190,000 yen is to be paid by 5,000-yen notes, 23,000 yen is to be paid by 1,000-yen notes and 5,000 yen is to be paid by 500-yen notes.

Figures 3, 3B:
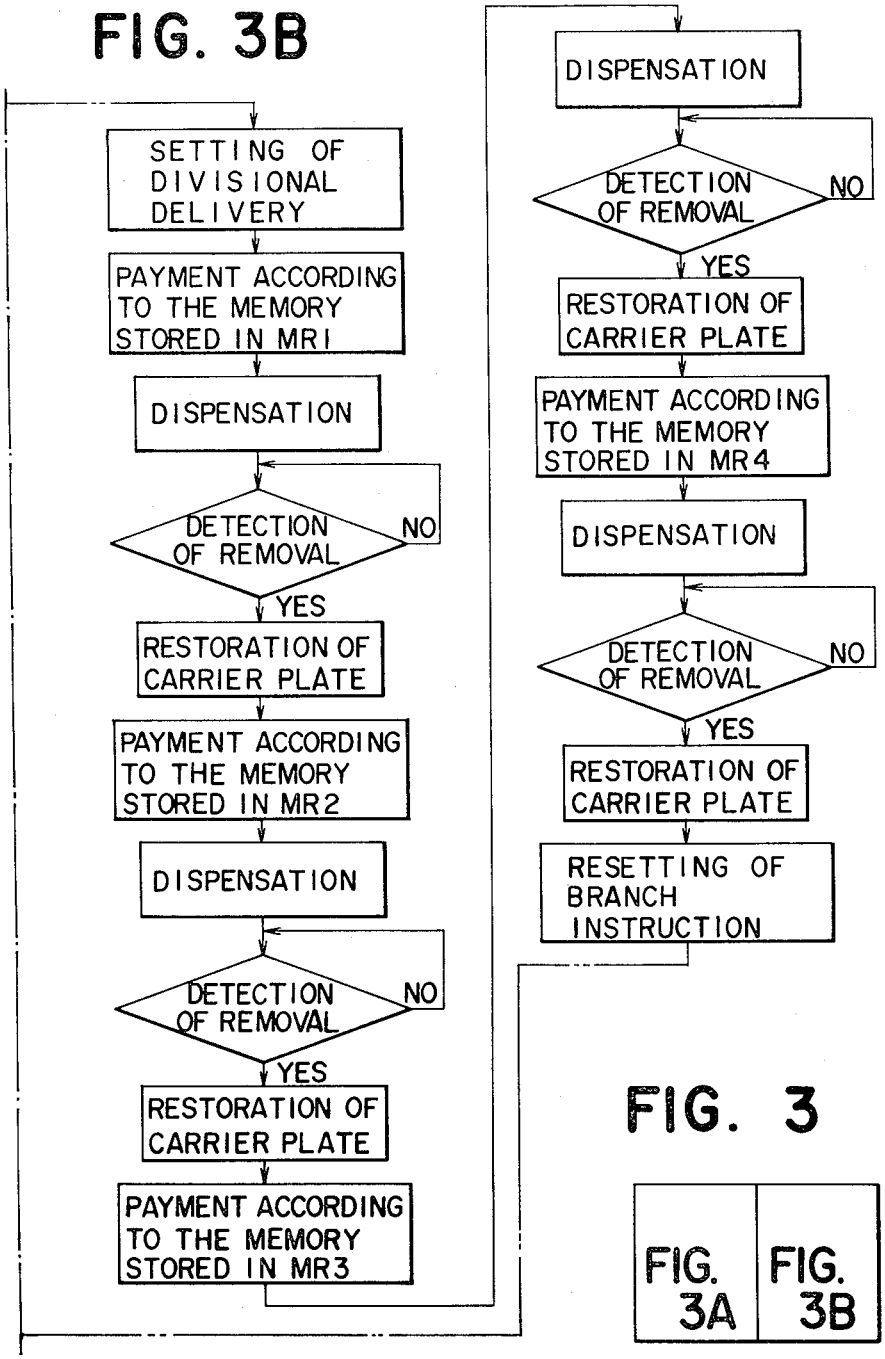
FIG. 3 shows how

Although the input operations by the operator are not shown in the flow chart of FIG. 3, the operator operates the input unit 11 to input the data so that the data of 500,000 yen, 190,000 yen, 23,000 yen and 5,000 yen are stored, respectively, in the memories $KR_1$, $KR_2$, $KR_3$ and $KR_4$. Then the start button of the input unit 11 is depressed to start the arithmetic operations to know the numbers of respective bank notes to be paid out (Step $P_1$). For example, the number of the 10,000-yen notes is computed according to the equation $KR_1$(500,000 yen)$\div U_1$(10,000 yen)$=MR_1$ (50 sheets), and the result is stored in $MR_1$ of the memory 12b for storing the numbers of sheets for respective bank notes to be paid out. Subsequently, the results of the arithmetic operations for respective bank notes are added together to obtain the grand total number of sheets to be paid out, and that grand total number is stored in the memory TMR (Step $P_2$). In this example, the grand total number stored in the memory TMR amounts to 121, since the data stored in the memories $MR_1$, $MR_2$, $MR_3$ and $MR_4$ are, respectively, 50, 38, 23 and 10. This grand total number stored in the memory TMR is compared to the upper limit number stored in the memory $U_5$ (Step $P_3$). Since the grand total number (TMR=121) is not less than the upper limit number ($U_5=100$), namely the discrimination instruction from the Step $P_3$ is NO, a branch instruction is developed (Step $P_4$) to instruct a divisional dispensation. Paying signals ($S_1$) are generated only for the 10,000-yen notes and for the 5,000-yen notes, and the 10,000-yen notes and the 5,000-yen notes are paid out and counted (Step $P_5$). As has been described hereinbefore, bank notes are paid out one by one in the following manner. Each bank note is grasped by the suction head 2 which is swung to guide the end of the grasped bank note to the paying belt assembly 4. The paying belt assembly 4 moves the bank note in the righthand direction as viewed in FIG. 1, and passes the same to the conveyor belt assembly 5. The bank note is conveyed upwards, and the leading end thereof abuts against one paddle 6*a* of the paddle wheel 6 and is inserted between a pair of adjacent paddles 6*a*. The paddle wheel 6 carries the bank note to a position above the accumulation station 7 where the bank note is scraped off by the action of the scraper plate 7*a* to be placed on the carrier plate 7*b*. The bank notes are successively accumulated on the carrier plate 7*b* and piled up in good order. The sensor assembly 9 senses the bank notes which have been paid out from the box 1 and moved across the sensor assembly, and generates counting signals which are fed to the control section 14.

In the illustrated example which is programmed to pay out the 10,000-yen notes first, the 10,000-yen notes are paid out until the counted number thereof is coincident with the number stored in the memory $MR_1$ of the memory 12*b* for storing the numbers of sheets for respective bank notes to be paid out. Paying of the 10,000-yen notes is stopped when the counted number sensed by the sensor assembly 9 is coincident with the number stored in the memory $MR_1$, and paying of the 5,000-yen notes is commenced, When the instructed number, 38 in this example, of 5,000-yen notes has been paid out, the counted number is coincident with the number stored in the memory $MR_2$ and paying of the 5,000-yen notes is stopped at that moment. Then an instruction signal ($S_3$) instructing that the 10,000-yen notes and the 5,000-yen notes accumulated on the carrier plate 7*b* be dispensed is generated from the control section 14. In response to this signal, the thrusting member 7*c* is actuated to push the carrier plate 7*b* out of the dispensing port 8 (Step $P_6$).

Upon removal of the bank notes by the operator, a sensor assembly 10*a* for detecting removal of the dispensed bank notes generate a removal detection signal ($S_4$) so that the discrimination instruction at the Step $P_7$ becomes YES. Whereupon, the carrier plate 7*b* is retracted to the normal position in the accumulation station 7 (Step $P_8$). Similarly, 1,000-yen notes are paid out until the counted number of the paid-out 1,000-yen notes is coincident with the number stored in the memory $MR_3$, and accumulated in the accumulation station 7. Paying of the 500-yen notes follows and terminates when the number of the paid-out 500-yen notes is coincident with the number stored in the memory $MR_4$. The Step $P_9$ operation is thus completed, and the Step $P_{10}$ operation follows to dispense the bundle of the 1,000-yen and 500-yen notes. When the discrimination instruction at the Step $P_{11}$ becomes YES upon removal of the bundle of the bank notes, the carrier plate 7*b* is retracted in the accumulation station 7 (Step $P_{12}$). Payment of the desired numbers of desired bank notes has been thus completed, and the branch instruction directing a divisional dispensation is then reset (Step $P_{16}$). If a malfunction in the paying operation is sensed by any one of the detection sensor assemblies 10, a reject signal ($S_5$) is generated to throw the accumulated bank notes on the carrier plate 7*b* into the reject box 18.

In a different example wherein the grand total number of bank notes to be paid out is less than the upper limit number stored in the memory $U_5$, the discrimination instruction from the Step $P_3$ is YES so that the 10,000-yen, 5,000-yen, 1,000-yen and 500-yen notes are paid out and counted sequentially (Step $P_{13}$) and the accumulated bundle of bank notes is dispensed together (Step $P_{14}$). When the discrimination instruction at the Step $P_{15}$ becomes YES upon removal of the bundle of bank notes, the carrier plate 7*b* is retracted in the accumulation station 7 to complete the paying operation. The operations of the printing and display units will not be described herein, because it is considered that such operations should be apparent to those skilled in the art.

If the device is instructed to pay out a single kind of bank notes at a time, the operation sequence follows the program shown by the dots-and-dash line in FIG. 3 so that the desired number of each kind of bank notes is dispensed at one time. In this mode of operation, one cycle of operation for dispensing a single kind of bank notes includes the step of paying out the instructed number of a certain kind of bank notes, the step of dispensing the bundle composed of bank notes of single kind, the step of detecting removal of the bundle and the step of retracting or restoring the carrier plate 7*b* in the accumulation step 7. After the one cycle operation, as described above, for dispensing a certain kind of bank notes, the next cycle of operation is started to repeat similar steps for dispensing another kind of bank notes.

As will be clearly understood from the foregoing, the apparatus according to the present invention is provided with discrimination means for comparing the grand total number of bank notes to be paid out with the upper limit number stored in the meory to develop a branch instruction directing that the operations be carried out according to a branch program when the grand total number is not less than the upper limit number. By the use of the apparatus according to the present invention, the divisional delivery of the bank notes is controlled such that bank notes of any one kind are never divided into two fragmental segments to avoid confusion which might lead the operator to make mistakes or, at least, might annoy the operator.

The invention may be embodied in other specific forms without departing from the spirit or essential characteristics thereof. The embodiment disclosed herein is therefore to be considered in all respects as illustrative and not restrictive, the scope of the invention being indicated by the appended claims rather than by the foregoing description, and all changes which come within the meaning and range of equivalency of the claim are therefore intended to be embraced therein.

What is claimed is:

1. A paper sheet dispensing apparatus wherein a plurality of different types of paper sheets are stored in separate groups for dispensing in response to a dispensing instruction, said apparatus comprising:

(a) means for determing the number of sheets of each type to be dispensed in response to a dispensing instruction;

(b) means for adding the number of sheets of each type to provide the total number of sheets to be dispensed in response to said dispensing instruction;

(c) a memory for storing an upper limit number of paper sheets which can be dispensed in a single dispensing operation;

(d) a comparator for comparing said total number of sheets with said upper limit number and for providing an output signal; and (e) dispensing means responsive to said comparator output signal when said total number exceeds said upper limit number for dispensing sheets of at least one given type during only a single dispensing operation so that successive dispensing operations in response to a given dispensing instruction do not include sheets of the same type.

2. A paper sheet dispensing apparatus in which kinds and numbers of paper sheets which are instructed to be dispensed are transferred from stack boxes for paper sheets to an accumulation station while paper sheets are counted and then the paper sheets are dispensed from the accumulation station, which apparatus comprises:

a dispenser mechanism section;

a memory section including a least a first memory for storing the upper limit number of paper sheets which can be dispensed at one time and a second memory for storing the total number of paper sheets to be dispensed;

an arithmetic unit including a comparator for comparing said upper limit number stored in said first memory with said total number stored in said second memory to generate a control signal for controlling said dispenser mechanism section; and a control section connected among said memory section, said arithmetic unit and said dispenser mechanism section for controlling the operation of said memory section, said arithmetic unit and said dispenser mechanism section, said control section controlling said dispenser mechanism section in response to said control signal fed from said comparator for dispensing paper sheets of different kinds collectively at one time when the total number of paper sheets to be dispensed does not exceed said upper limit number, and for dispensing the paper sheets of at least one given type during only a single dispensing operation so that successive dispensing operations in response to a given dispensing instruction do not include sheets of the same type when the total number of paper sheets to be dispensed exceeds said upper limit number.

* * * * *